US009312645B2

(12) United States Patent
Orris

(10) Patent No.: US 9,312,645 B2
(45) Date of Patent: Apr. 12, 2016

(54) STACKED ELECTRICAL SYSTEM FOR CONNECTING A PRINTED CIRCUIT BOARD TO A BUSBAR

(71) Applicant: Tyco Electronics Corporation, Berwyn, PA (US)

(72) Inventor: David Patrick Orris, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 34 days.

(21) Appl. No.: 14/301,795

(22) Filed: Jun. 11, 2014

(65) Prior Publication Data

US 2015/0364878 A1 Dec. 17, 2015

(51) Int. Cl.
*H01R 27/00* (2006.01)
*H01R 24/20* (2011.01)
*H01R 12/71* (2011.01)

(52) U.S. Cl.
CPC ..... *H01R 24/20* (2013.01); *H01R 12/716* (2013.01)

(58) Field of Classification Search
CPC ..... H01R 12/716
USPC ..... 439/55, 839, 637, 212; 177/361; 361/174
See application file for complete search history.

(56) References Cited

U.S. PATENT DOCUMENTS 3,384,856 A * 5/1968 Fisher ..... H02G 5/06 174/68.2
4,886,468 A * 12/1989 Harton ..... H02G 5/08 174/68.2
6,203,343 B1 * 3/2001 Chevassus-More ..... B60R 16/0207 174/72 B
7,581,972 B2 * 9/2009 Daamen ..... H01R 13/6315 439/249
8,388,389 B2 3/2013 Costello
8,784,131 B2 * 7/2014 Jeon ..... H01R 31/06 439/212
8,900,002 B2 * 12/2014 Mooney ..... H01R 4/60 439/212
2001/0025716 A1 * 10/2001 Buard ..... H02G 3/0418 174/481
2014/0065467 A1 * 3/2014 Choi ..... H01M 2/30 429/158
2014/0138149 A1 * 5/2014 Manhart ..... H02B 1/21 174/71 B
2014/0364009 A1 * 12/2014 Kondo ..... H01R 13/6625 439/620.09
2015/0104689 A1 * 4/2015 Frias ..... H01M 2/204 429/121

* cited by examiner

*Primary Examiner* — Abdullah Riyami
*Assistant Examiner* — Nelson R Burgos-Guntin

(57) ABSTRACT

An electrical system may include a busbar assembly and a connector assembly. The busbar assembly may include first and second busbars. A first contact tab extends from the first busbar. A second contact tab extends from the second busbar. The first and second contact tabs include first and second interface ends, respectively, within a common plane. The connector assembly includes a housing that retains first and second electrical contacts. The first electrical contact includes a first contact terminal and the second electrical contact includes a second contact terminal. The first contact terminal defines a first interfacing space and the second contact terminal defines a second interfacing space. The first and second interfacing spaces are aligned with one another. The first and second interface ends are configured to mate with the first and second contact terminals within the first and second interfacing spaces, respectively.

14 Claims, 3 Drawing Sheets

STACKED ELECTRICAL SYSTEM FOR CONNECTING A PRINTED CIRCUIT BOARD TO A BUSBAR

BACKGROUND OF THE DISCLOSURE

Embodiments of the present disclosure generally relate to electrical systems configured to connect a printed circuit board to a bus bar.

Orthogonal or right angle connectors have been used to connect printed circuit boards to other components, such as bus bars. A typical right angle connector may include a plurality of receiving terminals oriented at a right angle to a number of a plurality of pins or tails that are received and retained within reciprocal features of a printed circuit board.

In some electrical systems, power may be delivered to a printed circuit board through a busbar, for example. A busbar typically includes a planar strip of conductive material, such as copper, having opposite sides that are engaged by a busbar connector. Known busbar connectors include a housing that holds two opposed mating contacts. When a busbar is inserted between the opposed mating contacts, each of the mating contacts electrically engages a corresponding side of the busbar.

A typical busbar connector includes two electrical contacts that are oriented in a side-by-side manner. For example, one electrical contact, which may be a power contact, is positioned to one side of the housing, while the other electrical contact, which may be a ground contact, is positioned on an opposite side of the housing.

However, in various applications, such a side-by-side arrangement may not efficiently and easily fit within a confined space of a component. In short, known busbar connectors and busbars may not fit within a chassis of a particular component.

There is a need for an electrical system having a reconfigured busbar connection.

BRIEF DESCRIPTION OF THE DISCLOSURE

Certain embodiments of the present disclosure provide an electrical system that may include a busbar assembly and a connector assembly. The busbar assembly may include first and second busbars. A first contact tab extends from the first busbar, and a second contact tab extends from the second busbar. The first and second contact tabs include first and second interface ends, respectively, within a common plane. The connector assembly may include a housing that retains first and second electrical contacts. The first electrical contact includes a first contact terminal and the second electrical contact includes a second contact terminal. The first contact terminal defines a first interfacing space and the second contact terminal defines a second interfacing space. The first and second interfacing spaces are aligned with one another. The first and second interface ends are configured to mate with the first and second contact terminals within the first and second interfacing spaces, respectively.

In at least one embodiment, the first and second interface ends are stacked with respect to the common plane. The first and second contact terminals may also be stacked with respect to the common plane.

The first and second interface ends may be vertically stacked. Similarly, the first and second contact terminals may be vertically stacked.

The first and second contact tabs may include first and second parallel linear extensions, respectively, connected to first and second inward bends, respectively, that position the first and second interface ends within the common plane.

In at least one embodiment, one of the first and second electrical contacts is taller than the other of the first and second electrical contacts.

The first electrical contact may include a first intermediate body. The first contact terminal extends from the first intermediate body. Similarly, the second electrical contact may include a second intermediate body, such that the second contact terminal extends from the second intermediate body. The first and second intermediate bodies may be on opposite sides of a central longitudinal plane within the housing. The first and second interfacing spaces may be aligned in the central longitudinal plane.

The electrical system may also include a printed circuit board electrically connected to the first and second electrical contacts.

In at least one embodiment, the first busbar is configured to operate at a first polarity, and the second busbar is configured to operate at a second polarity that differs from the first polarity.

Certain embodiments of the present disclosure provide a busbar assembly configured for use in an electrical system. The busbar assembly may include a first busbar including a first contact tab having a first interface end configured to mate with a first electrical contact, and a second busbar including a second contact tab having a second interface end configured to mate with a second electrical contact. The first and second interface ends are within a common plane, such as a plane that is parallel with a longitudinal central plane of the assembly.

Certain embodiments of the present disclosure provide a connector assembly for use in an electrical system. The connector assembly may include a housing that retains first and second electrical contacts. The first electrical contact includes a first contact terminal and the second electrical contact includes a second contact terminal. The first contact terminal defines a first interfacing space and the second contact terminal defines a second interfacing space. The first and second interfacing spaces have at least portions that are aligned with one another in a common plane.

DETAILED DESCRIPTION OF THE DISCLOSURE

Figure 1:
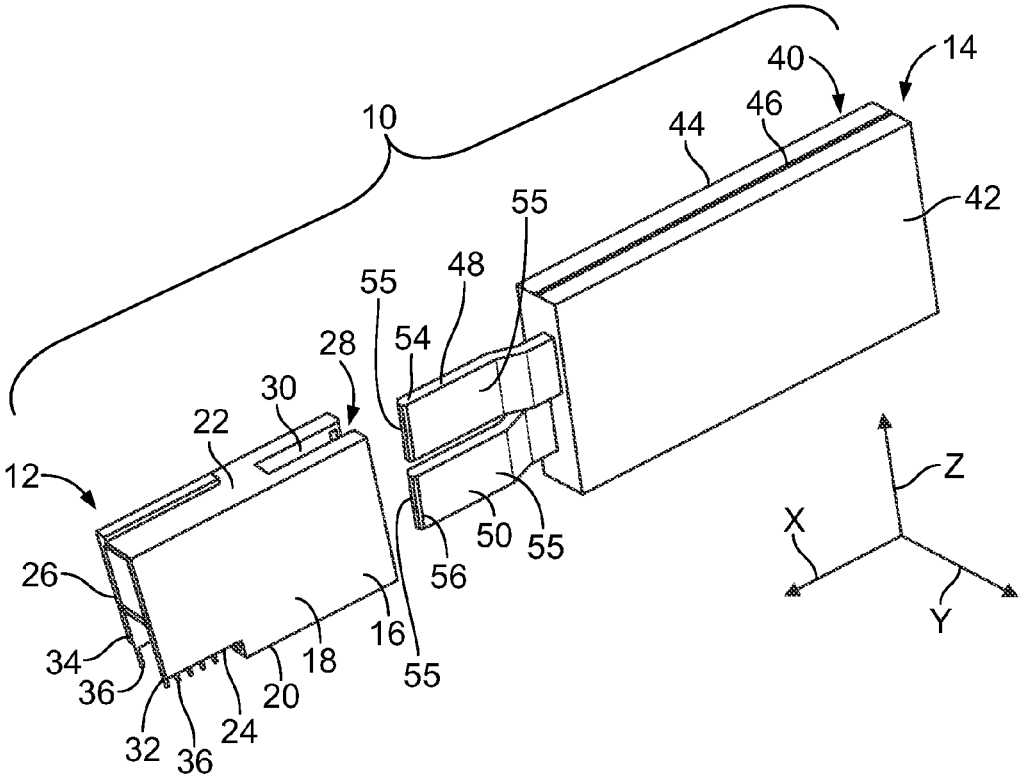
FIG. 1 illustrates a perspective top view of an electrical system, according to an embodiment of the present disclosure.

FIG. 1 illustrates a perspective top view of an electrical system 10, according to an embodiment of the present disclosure. The electrical system 10 may include a connector assembly 12, such as a busbar connector assembly, and a busbar assembly 14.

The connector assembly 12 may include a housing 16, which may be formed of plastic, having lateral walls 18 connected to a base 20 and a top wall 22. A circuit board connection notch 24 may be formed through a portion of the base 20. Portions of electrical contacts 32 and 34 may extend out of the circuit board connection notch 24 in order to mate with reciprocal features of a printed circuit board. The housing 16 also includes opposite ends 26 and 28, respectively. The end 28 may be a busbar interface end that includes an interface channel 30 that extends from the base 20 to the top wall 22. The interface channel 30 is configured to receive and retain contact tabs 48 and 50 of the busbar assembly 14. The end 26 may be open (as shown) or closed.

The housing 16 retains first and second electrical contacts 32 and 34 therein, such as ground and power contacts. The electrical contacts 32 and 34 each include pins, tails, or the like 36 that are configured to be received and retained by reciprocal features, such as vias, through-holes, or the like, formed through a printed circuit board, for example.

The housing 16 may be formed of a dielectric material, for example, while the electrical contacts 32 and 34 may be formed of conductive metal. The connector assembly 12 is configured to electrically connect the busbar assembly 14 to a printed circuit board, for example.

The busbar assembly 14 includes a main body 40 that may include a first planar busbar 42 and a second planar busbar 44 separated by an insulating layer 46. Each busbar 42 and 44 may be formed of a conductive material, such as copper, brass, aluminum, or the like. Each busbar 42 and 44 may be a flat or hollow strip, panel, tube, rod, or the like. The busbar assembly 14 may be laminated to secure the busbars 42 and 44 and insulating layer 46 together. For example, the insulating layer 46 may include adhesive on either side that securely adheres to the busbars 42 and 44, and the entire busbar assembly 14 may be laminated together.

The busbar 42 includes an outwardly extending contact tab 48, while the busbar 44 includes an outwardly extending contact tab 50. The contact tabs 48 and 50 are configured to be inserted into the interface channel 30 of the connector assembly 12 to make electrical contact with contact terminals of the electrical contacts 34 and 32, respectively.

The busbar 42 may be configured to operate at a first polarity, while the busbar 44 may be configured to operate at a second polarity that differs from the first polarity. For example, the busbar 42 may be a 0V busbar configured to be a ground busbar, while the busbar 44 may be a 48V busbar configured to convey power, for example, or vice versa. As such, the electrical contact 34 that connects to the busbar 42 may be a ground contact, while the electrical contact 32 that connects to the busbar 44 may be a power contact.

The contact tabs 48 and 50 of the busbar assembly 14 mate with contact terminals of the electrical contacts 34 and 32, respectively, within the interface channel 30 of the connector assembly 12 in a stacked, vertical relationship. For example, the contact tab 48 includes an interface end 54 that is aligned over an interface end 56 of the contact tab 50 in a plane that is parallel to the X-Z plane (shown in FIG. 1). That is, the interface ends 54 and 56 may reside in the same plane (that is, a common plane), such as a vertical plane that is parallel with the X-Z plane. The interface ends 54 and 56 are aligned within the common plane such that they are oriented the same. For example, as shown, the lateral walls 55 of the interface ends 54 and 56 are both upright and parallel with the X-Z plane. The common plane may have the same thickness as the interface ends 54 and 56 (for example, the distance between opposed lateral walls 55). An entirety of each of the interface ends 54 and 56 may reside in the common plane. For example, the interface ends 54 and 56 (that is, the portions of the contact tabs 48 and 50 that directly mate and contact with the contact terminals of the connector assembly 10) may be coplanar. The contact terminals of the electrical contacts 32 and 34 of the connector assembly 12 mate with the interface ends 56 and 54, respectively, in a vertically stacked orientation, as described below.

Figure 2:
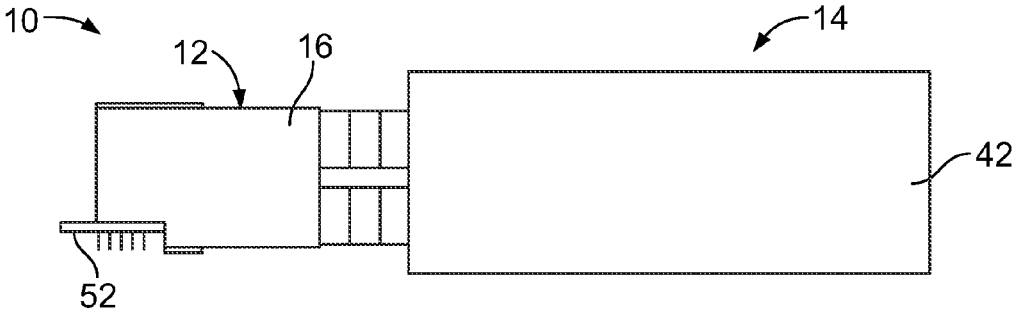
FIG. 2 illustrates a lateral view of an electrical system connected to a printed circuit board, according to an embodiment of the present disclosure.

FIG. 2 illustrates a lateral view of the electrical system 10 connected to a printed circuit board 52, according to an embodiment of the present disclosure. Referring to FIGS. 1 and 2, the tails 36 of the electrical contacts 32 and 34 securely mate with reciprocal features, such as vias, through-holes, or the like, formed through or within the printed circuit board 52. The contact tabs 48 and 50 electrically mate with the electrical contacts 34 and 32, respectively, within the interface channel 30.

Figure 3:
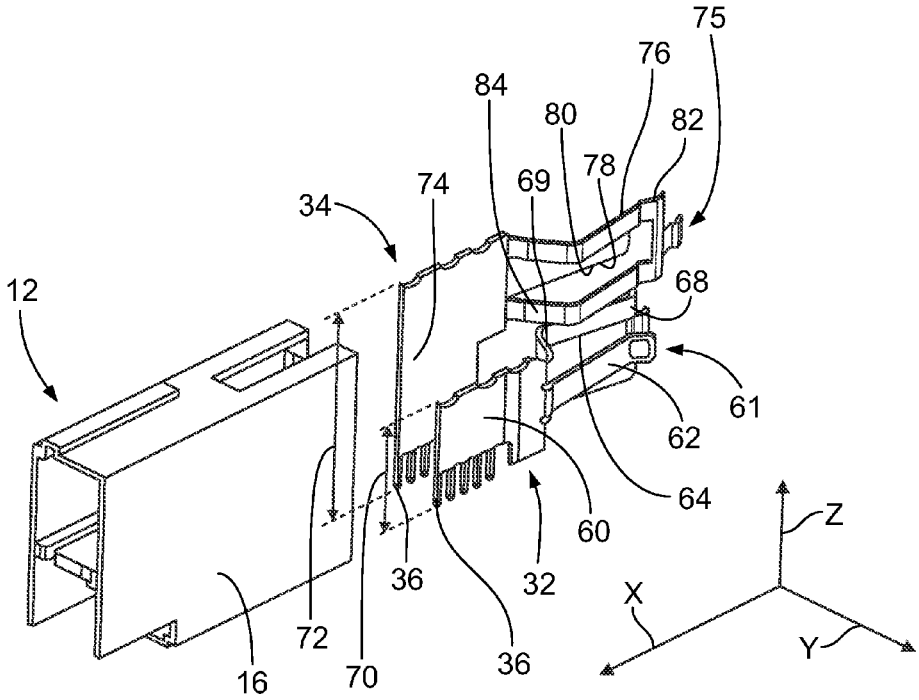
FIG. 3 illustrates a perspective top exploded view of a connector assembly, according to an embodiment of the present disclosure.

FIG. 3 illustrates a perspective top exploded view of the connector assembly 12, according to an embodiment of the present disclosure. As shown in FIG. 3, the electrical contacts 32 and 34 are removed from the housing 16. The electrical contact 32 includes a planar intermediate body 60, such as a planar sheet or panel, that connects the tails 36 to a contact terminal 61 having opposed contacting members 62 and 64. The intermediate body 60 may connect the tails 36 to the contacting members 62 and 64 in a right angle fashion. As shown, the contacting member 62 may include a single beam that extends outwardly from and generally in line with the plane of the intermediate body 60. The contacting member 64 may include parallel beams 68 vertically separated from one another. The parallel beams 68 may be offset with respect to the plane of the intermediate body 60 by canted, bent, curved, or the like extensions 69 that position the parallel beams out of the plane of the intermediate body 60. As shown, the electrical contact 32 generally extends to a height 70, which may be half or less than a height 72 of the electrical contact 34. As such, the electrical contact 34 is taller than the electrical contact 32. Alternatively, the contacting member 62 may include two vertically separated beams, while the contacting member 64 is a single beam. Also, alternatively, each of the contacting members 62 and 64 may be a single beam, or two vertically separated beams. For example, the contacting members 62 and 64 may each be single beams that are horizontally aligned with one another.

Similar to the electrical contact 32, the electrical contact 34 includes a planar intermediate body 74 that connects the tails 36 to a contact terminal 75 having opposed contacting members 76 and 78. The intermediate body 74 may extend to a height that may be greater than that of the intermediate body 60. For example, the intermediate body 74 may be double the height of the intermediate body 60. However, the intermediate body 74 may extend to a height that is less than double that of the intermediate body 60. The intermediate body 74 is sized and shaped to position the contact terminal 75 over the contact terminal 61. As shown, the contacting member 78 may be a single beam 80 that extends outwardly from and generally in line with the plane of the intermediate body 74. The contacting member 76 may include parallel beams 82 vertically separated from one another. The beams 82 may be offset with respect to the plane of the intermediate body 74 by canted, bent, curved, or the like extensions 84 that position the parallel beams out of the plane of the intermediate body 74. Alternatively, the contacting member 78 may include two vertically separated beams, while the contacting member 76 is a single beam. Also, alternatively, each of the contacting members 76 and 78 may be a single beam, or two vertically separated beams. For example, the contacting members 76 and 78 may each be single beams that are horizontally aligned with one another.

As shown, the intermediate bodies 60 and 74 may generally be positioned and oriented as parallel plates separated from one another with respect to the Y axis. That is, portions of the intermediate bodies 60 and 74 may be oriented in a side-by-side fashion. However, the intermediate body 74 positions the contact terminal 75 above the contact terminal 61. The canted extensions 84 may cant the contacting members 76 directly over the contacting member 62 with respect to the X-Z plane, while the canted extensions 69 may cant the contacting member 64 directly below the contacting member 78 with respect to the X-Z plane. Accordingly, the contact terminals 61 and 75 of the electrical contacts 32 and 34, respectively, are configured to compressively contact the interface ends 56 and 54 of the contact tabs 50 and 48, respectively, in a vertical plane that is parallel with the X-Z plane.

Figure 4:
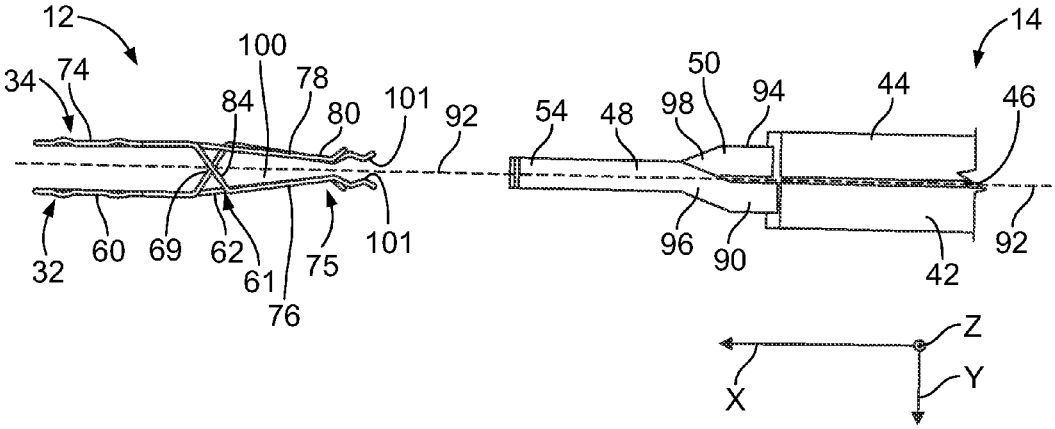
FIG. 4 illustrates a top view of electrical contacts aligned with contact tabs of busbars, according to an embodiment of the present disclosure.

FIG. 4 illustrates a top view of the electrical contacts 32 and 34 aligned with contact tabs 50 and 48, respectively, of the busbars 44 and 42, respectively, according to an embodiment of the present disclosure. The contact tab 48 includes a linear extension 90 offset from one side a central longitudinal plane 92, while the contact tab 50 includes a linear extension 94 offset from an opposite side of the central longitudinal plane 92. The linear extensions 90 and 94 are generally parallel to one another and the central longitudinal plane 92, with the contact tab 48 being at a height that is greater than that of the contact tab 50. Each linear extension 90 and 94 connects to an inward bend 96 and 98, respectively, that bends toward the longitudinal plane 92 so that the linear interface ends 54 and 56, respectively (the interface end 56 is hidden from view in FIG. 4), are vertically aligned with one another with respect to the longitudinal plane 92.

Similarly, the contact terminals 61 and 75 (shown in FIG. 3) of the electrical contacts 32 and 34, respectively, are similarly sized and shaped so that interfacing spaces 100 are aligned with the longitudinal plane 92. Referring to FIGS. 3 and 4, the canted extensions 69 and 84 extending from the intermediate bodies 60 and 74, respectively, provide the interfacing spaces 100 between the planes of the contacting members 62, 64, and 76, 78, respectively.

As shown, distal ends 101 of the contacting members 62, 64, 76, and 78 may be outturned. The outturned distal ends 101 of the contacting members 62, 64, 76, and 78 allow the interface ends 54 and 56 of the contacts tabs 48 and 50, respectively, to be smoothly guided between the contacting members 62, 64, 76, and 78. Alternatively, the distal ends 101 may not be outturned.

As also shown, the opposed contacting members 62, 64 and 76, 78 converge toward one another proximate to the distal ends 101 before turning outward. The inward converging of the contacting members 62, 64 and 76, 78 provides increased compressive engagement with the interface ends 54 and 56 of the contact tabs 48 and 50. Alternatively, the contacting members may not inwardly converge, but instead may be parallel with the central longitudinal plane 92.

As the contact tabs 50 and 48 mate with the electrical contacts 32 and 34, respectively, the contacting members 62 and 64 deflect outwardly over the outer surfaces of the contact tab 50, while the contacting members 76 and 78 deflect outwardly over the outer surfaces of the contact tab 48, thereby providing a compressive, sandwiching electrical connection. As shown, the contact terminals of the electrical contacts 32 and 34 are vertically stacked or otherwise oriented to provide interfacing spaces 100 that are aligned with the longitudinal plane 92, which is parallel with the X-Z plane. The electrical contacts 32 and 34 mate with the vertically stacked or otherwise oriented contacts tabs 50 and 48, respectively, of the busbar assembly 14.

Referring to FIGS. 1-4, embodiments of the present disclosure provide an electrical system that may exhibit a small form factor and include two isolated poles, such as a ground pole and a power pole. The vertical stacked relationship of the electrical terminals of the electrical contacts and the contact tabs of the busbar assembly allow the electrical system to fit into smaller spaces and be used with respect to various orientations. Embodiments of the present disclosure provide an electrical system that includes a connector assembly that may mate in a vertically-stacked orientation with respect to a busbar assembly.

Figure 5:
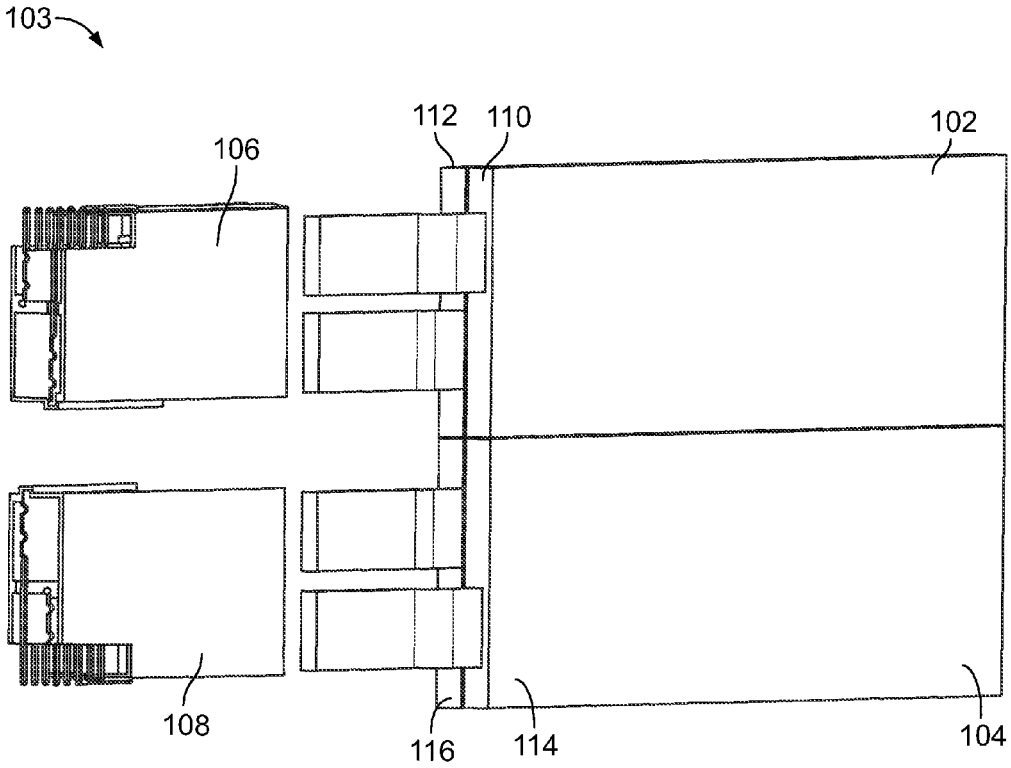
FIG. 5 illustrates a perspective lateral view of an electrical system, according to an embodiment of the present disclosure.

FIG. 5 illustrates a perspective lateral view of an electrical system 103, according to an embodiment of the present disclosure. The electrical system 103 may include first and second busbar assemblies 102 and 104 that mate with first and second connector assemblies 106 and 108, respectively. Each of the busbar assemblies 102 and 104 may be formed as the busbar assembly 14, described above. Further, each of the connector assemblies 106 and 108 may be formed as the connector assembly 12, described above.

The busbar assembly 102 may include a busbar 110 that operates at a first polarity and a busbar 112 that operates at a second polarity that differs from the first polarity. Similarly, the busbar assembly 104 may include a busbar 114 that operates at the first polarity and a busbar 116 that operates at the second polarity. As shown, the busbar assemblies 102 and 104 may be inverted with respect to one another. Similarly, the connector assemblies 106 and 108 may be flipped with respect to one another and configured to connect to a respective printed circuit board (not shown in FIG. 5). Instead of using unique connector assemblies and busbar assemblies, the electrical system 103 may utilize busbar assemblies of the same construction, and connector assemblies of the same construction. In this manner, the electrical system 103 may be a modular system that utilizes modular connector assemblies and modular busbar assemblies to form a system of a desired size, shape, and orientation.

The orientation of the contact tabs of the busbar assemblies ensures that the contact tabs mate with the reciprocal contact terminals of the electrical contacts, thereby ensuring proper contact polarity. Accordingly, a single type of connector assembly, a single type of busbar assembly, and a single type of printed circuit board may be used to provide multiple connector assemblies of the same design, multiple busbar assemblies of the same design, and multiple printed circuit boards of the same design that may be used to form an electrical system of varying sizes, shapes, orientations, and the like.

Embodiments of the present disclosure provide electrical systems that include connector assemblies that electrically connect printed circuit boards to busbar assemblies in a vertically stacked fashion. The electrical contacts of the connector assemblies include contact terminals that are aligned with respect to a vertical plane, for example, and mate with contact tabs of busbar assemblies in a stacked, vertical configuration, as opposed to mating in a side-by-side fashion.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical system, comprising:

a busbar assembly including first and second bush ars, wherein a first contact tab extends from the first busbar, and a second contact tab extends from the second busbar, wherein the first and second contact tabs include first and second interface ends, respectively, within a common plane; and a connector assembly including a housing that retains first and second electrical contacts, wherein each of the first and second electrical contacts is a one-piece unit, wherein the first electrical contact includes a first contact terminal and the second electrical contact includes a second contact terminal, wherein the first contact terminal defines a first interfacing space and the second contact terminal defines a second interfacing space, wherein the first and second interfacing spaces are aligned with one another, and wherein the first and second interface ends are configured to mate with the first and second contact terminals within the first and second interfacing spaces, respectively.

2. The electrical system of claim 1, wherein the first and second interface ends are stacked with respect to the common plane, and wherein the first and second contact terminals are stacked with respect to the common plane.

3. The electrical system of claim 1, wherein the first and second interface ends are vertically stacked, and wherein the first and second contact terminals are vertically stacked.

4. The electrical system of claim 1, wherein the first and second contact tabs comprise first and second parallel linear extensions, respectively, connected to first and second inward bends, respectively, that position the first and second interface ends within the common plane.

5. The electrical system of claim 1, wherein one of the first and second electrical contacts is taller than the other of the first and second electrical contacts.

6. The electrical system of claim 1, wherein the first electrical contact further comprises a first intermediate body, wherein the first contact terminal extends from the first intermediate body, wherein the second electrical contact further comprises a second intermediate body, wherein the second contact terminal extends from the second intermediate body, wherein the first and second intermediate bodies are on opposite sides of a central longitudinal plane within the housing, and wherein the first and second interfacing spaces are aligned in the central longitudinal plane.

7. The electrical system of claim 1, further comprising a printed circuit board electrically connected to the first and second electrical contacts.

8. The electrical system of claim 1, wherein the first busbar operates at a first polarity, and wherein the second busbar operates at a second polarity that differs from the first polarity.

9. A connector assembly for use in an electrical system, the connector assembly:

a housing that retains first and second electrical contacts, wherein each of the first and second electrical contact is a one-piece unit, wherein the first electrical contact includes a first contact terminal and the second electrical contact includes a second contact terminal, wherein the first contact terminal defines a first interfacing space between first opposed contacting members and the second contact terminal defines a second interfacing space between second opposed contacting member, wherein the first and second interfacing spaces have at least portions that are aligned with one another in a common plane.

10. The connector assembly of claim 9, wherein one of the first and second electrical contacts is taller than the other of the first and second electrical contacts.

11. The connector assembly of claim 9, wherein the first electrical contact further comprises a first intermediate body, wherein the first contact terminal extends from the first intermediate body, wherein the second electrical contact further comprises a second intermediate body, wherein the second contact terminal extends from the second intermediate body, wherein the first and second intermediate bodies are on opposite sides of a central longitudinal plane within the housing, and wherein the first and second interfacing spaces are aligned in the central longitudinal plane.

12. The connector assembly of claim 9, further comprising a printed circuit board electrically connected to the first and second electrical contacts.

13. The electrical system of claim 6, wherein the first electrical contact further comprises a first single beam that extends outwardly from and in line with the first intermediate body, and first parallel beams offset from the first intermediate body that oppose the first single beam, and wherein the second electrical contact further comprises a second single beam that extends outwardly from and in line with the second intermediate body, and second parallel beams offset from the second intermediate body that oppose the second single beam.

14. The connector assembly of claim 11, wherein the first opposed contacting members comprise a first single beam that extends outwardly from and in line with the first intermediate body, and first parallel beams offset from the first intermediate body that oppose the first single beam, and wherein the second opposed contacting members comprises a second single beam that extends outwardly from an in line with the second intermediate body, and second parallel beams offset from the second intermediate body that oppose the second single beam.

* * * * *